United States Patent [19]

Patzke et al.

[11] 4,023,592

[45] May 17, 1977

[54] PUMP AND METERING DEVICE

[75] Inventors: Robert C. Patzke, Prospect Heights; Thomas V. DeRyke, Libertyville; Stephen Ernohazy; Eugene P. Oddo, both of Mount Prospect, all of Ill.

[73] Assignee: Addressograph Multigraph Corporation, Cleveland, Ohio

[22] Filed: Mar. 17, 1976

[21] Appl. No.: 667,865

[52] U.S. Cl. ..... 137/565; 137/590; 417/437

[51] Int. Cl.[2] ..... F17D 1/13; B67D 3/00; F04B 19/04; F04B 23/02

[58] Field of Search ..... 417/437, 901; 137/565, 137/590

[56] References Cited

UNITED STATES PATENTS

| | | | |
|---|---|---|---|
| 1,888,615 | 11/1932 | Berdon | 137/565 |
| 2,096,015 | 10/1937 | Von Meister et al. | 34/54 |
| 2,097,492 | 11/1937 | Lang | 137/565 |
| 2,384,155 | 9/1945 | Brunk | 34/162 |
| 2,696,771 | 12/1954 | Franz | 137/565 |
| 3,344,746 | 10/1967 | Scovell | 417/901 |

*Primary Examiner*—John J. Vrablik
*Attorney, Agent, or Firm*—Sol L. Goldstein; Michael A. Kondzella

[57] ABSTRACT

A self-priming pump is provided for metering a positive controlled amount of a volatile liquid to a utilization device. The pump comprises a piston means for pumping the liquid from a liquid supply container to a chamber, and from the chamber to a reservoir where the liquid is maintained at a uniform and constant level by an overflow port which drains any excess liquid back to the liquid supply container. The liquid remaining in the reservoir flows through an outlet passage to a well from which the liquid is dispensed in metered units under control of an adjustable needle valve. The needle valve is provided for controlling the rate of feed of the liquid to the utilization device, and is accessible for adjusting the liquid flow while the pump is in operation. The reservoir is also provided with vent means to prevent impediment of liquid flow and, also, to permit liquid flow immediately in response to initial start-up and operation of the pump.

8 Claims, 5 Drawing Figures

36
40
42
38
44
46
48
26

10
50
54
76
78
56
64
52
84
30
12
62
60
58
72
66
68
82
28
86
74
70
80
34
32

PUMP AND METERING DEVICE

BACKGROUND OF THE INVENTION

Solenoid operated pumps for handling volatile liquids, such as aqueous ammonia, are inefficient because they are not true positive displacement pumps. Rather, such pumps meter the amount of liquid by adjusting the length of the stroke, which is a long procedure. Also, when gas bubbles form in the intake tube the pump discharges a varying amount of liquid due to the compression and expansion of the gas bubbles thereby preventing accurate metering of the liquid to be fed to the developer unit.

Further, because such pumps move relatively small quantities of the liquid, or ammonia, and have a built-in tendency to heat up due to the electromagnetic coil, thereby exposing the ammonia to temperatures above its boiling point, the ammonia begins to boil and the pump fails to function.

Air operated pumps, designed normally to run at relatively high piston speeds, are also known and attempts have been made to alter such pumps for use in feeding aqueous ammonia to a diazo process reproduction machine. Because such a pump requires modification to considerably slow down the piston speed, to permit pumping a reduced amount of ammonia, the valves becom inefficient to the point where they no longer open and close properly unless they are immersed in fluid. Subsequently, when the pump input line and pump chamber are void of ammonia, as would be the case with initial machine start-up, the system is not able to pump the ammonia from the bottle to the pump chamber.

Additionally, such a modified air operated pump results in the ammonia and water solution saturating the piston seal. Once the piston seal is saturated the unit is not capable of generating either a vacuum or pressure cycle due to leakage of air around the piston seal.

For the foregoing reasons, presently available pumps and metering devices currently in use for handling fluids such as aqueous ammonia are ineffective and unreliable in use. Applicants ae unaware of any commercially available or prior art device which meets the rigid requirements of a device for pumping and precisely metering the rate of feed of aqueous ammonia from a supply container to a developer unit of a diazo process reproduction machine.

SUMMARY OF THE INVENTION

The present invention provides a self-priming pump device for accurately metering a positive controlled amount of a volatile liquid and/or a chemically reactive fluid such as, for example, 26° B aqueous ammonia to a developing unit of a diazo reproduction machine.

The pump comprises an inlet valve which allows ammonia, for example, to flow from an ammonia supply through an inlet line to a chamber of the pump. The pump includes a power driven piston, operating within the chamber, causing the ammonia to flow from the ammonia supply to the chamber in response to an upward stroke of the piston which generates a vacuum within the chamber thereby withdrawing the ammonia from the ammonia supply. Flow of the ammonia from the chamber to the ammonia supply container is resisted by the inlet valve. The ammonia withdrawn from the ammonia supply, after passing through the inlet valve, enters the chamber.

Upon completion of the upward stroke of the piston, the piston reverses itself and commences a downward stroke. The downward piston movement pressurizes the chamber and the inlet valve closes because it resists flow of the ammonia from the chamber to the ammonia supply. An outlet valve associated with the chamber, which is closed on the upward or vacuum stroke of the piston, opens on the pressure or downward piston stroke thereby causing ammonia flow from the chamber into a reservoir and an oveflow system of the pump.

When the reservoir is filled to capacity any excess ammonia therein traverses to an overflow port and drains back to the ammonia supply. That ammonia which is retained in the reservoir travels through an outlet passage at the base of the reservoir to a well comprising a needle valve for metering the ammonia to the developer unit. The pump is also provided with a pair of vent openings to insure that the system will not experience an internal build-up which would impede the flow of the ammonia. One vent is utilized to equilibrate the reservoir area to the atmosphere and the other vent equilibrates the atmosphere in a developer feed tube, extending from the pump to the developer unit, to that of the reservoir. Suitable exhaust means are also provided to prevent discharge of ammonia fumes directly to the atmosphere.

It is an object of the invention to provide an improved selfpriming pump device for metering a positive controlled amount of chemically reactive fluid or a volatile liquid.

Another object of the invention is to provide such a pump and metering device which includes means accessible for adjusting the rate of flow of the fluid while the pump is in operation.

Another object of the invention is to provide a pump constructed of materials impervious to attack by chemically reactive fluids, and one which is capable of generating either a vacuum or pressure cycle without leakage of air around the piston seal.

Another object of the invention is to provide a pump device which, unlike prior art devices, does not require that the valve means be immersed in the fluid in order to open and close properly, thereby permitting the device to pump the fluid from the fluid supply to the pump chamber with initial machine start-up.

Another object of the invention is to provide a pump and metering device for precisely controlling the rate of flow of fluid, which device is durable in use, reliable in operation and relatively inexpensive to manufacture.

Other objects and advantages of the invention will appear hereinafter as the description proceeds.

IN THE DRAWING

DESCRIPTION OF THE PREFERRED EMBODIMENT

While the invention herein discloses a device for supplying and metering 26° B aqueous ammonia to a developing unit of a diazo copying machine, it is to be understood that the pump and metering device may be utilized for supplying and accurately metering chemically reactive fluids and volatile liquids other than ammonia for various applications and types of machines.

Figure 1:
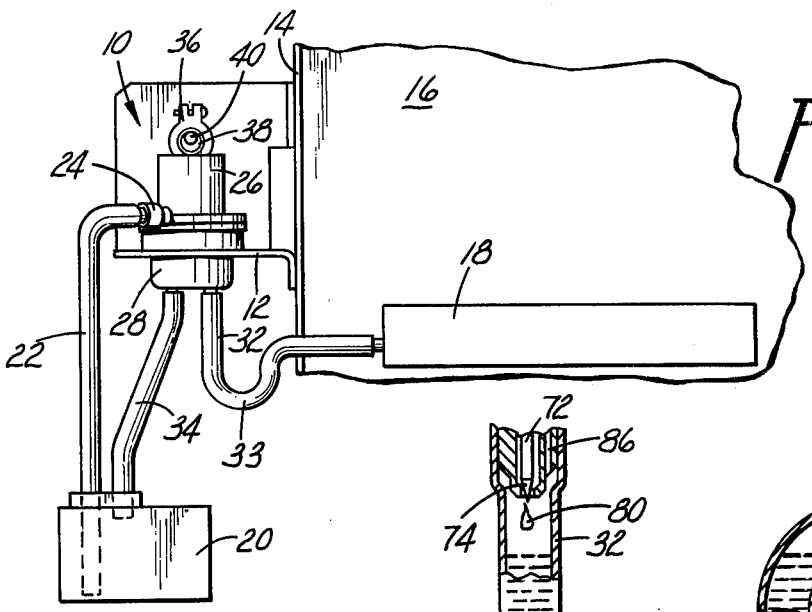
FIG. 1 is a front elevation of a pump and metering device for controlling the rate of feed of a volatile liquid from a liquid supply to a utilization device in accordance with the present invention.
Figure 2:
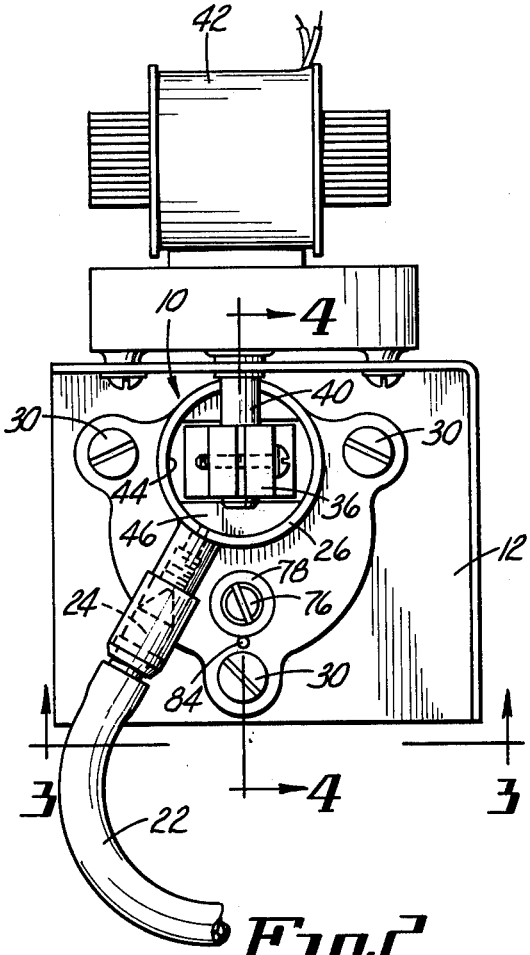
FIG. 2 is a plan view of the pump and liquid metering device.
Figure 3:
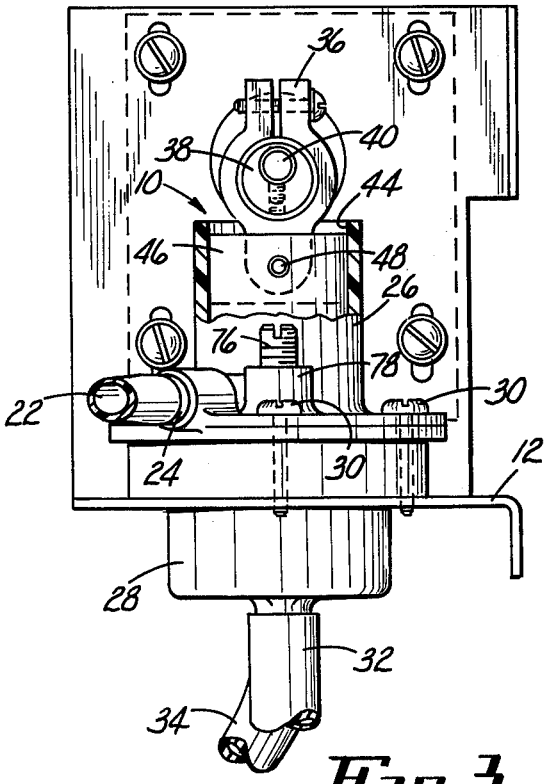
FIG. 3 is an end elevational of the pump and liquid metering device.

With reference to FIG. 1, the present invention comprises a pump and metering device indicated generally by the reference numeral 10 mounted on a support 12 secured to a side plate 14 of a diazo reproduction machine 16. The pump 10 is adapted to pump fluid to a developing unit 18 of the machine 16. An inlet supply line or feed tube 22 extends from a container 20 to an inlet valve 24 for conveying ammonia from the container to the pump 10 in response to operation of the pump. The pump 10 comprises an upper housing 26 mounted to a lower housing 28 by suitable fastening means such as screws 30 shown in FIGS. 2–4. A transparent feed supply line or tube 32 is connected at one end to the lower housing 28 and at its other end to the developing unit 18. As will be explained hereinafter, the tube 32 conveys the ammonia from the pump 10 to the developing unit 18 in accurately controlled metered amounts. A drain tube 34 is provided and extends from the lower housing 28 to the supply container 20 for draining and returning to the container any excess ammonia that might be supplied to the pump 10. A drive means is also provided and includes a connecting rod 36 rotatably supporting an eccentric member 38 secured on a drive shaft 40 of a drive motor 42 as shown in FIGS. 2–4.

Figure 4:
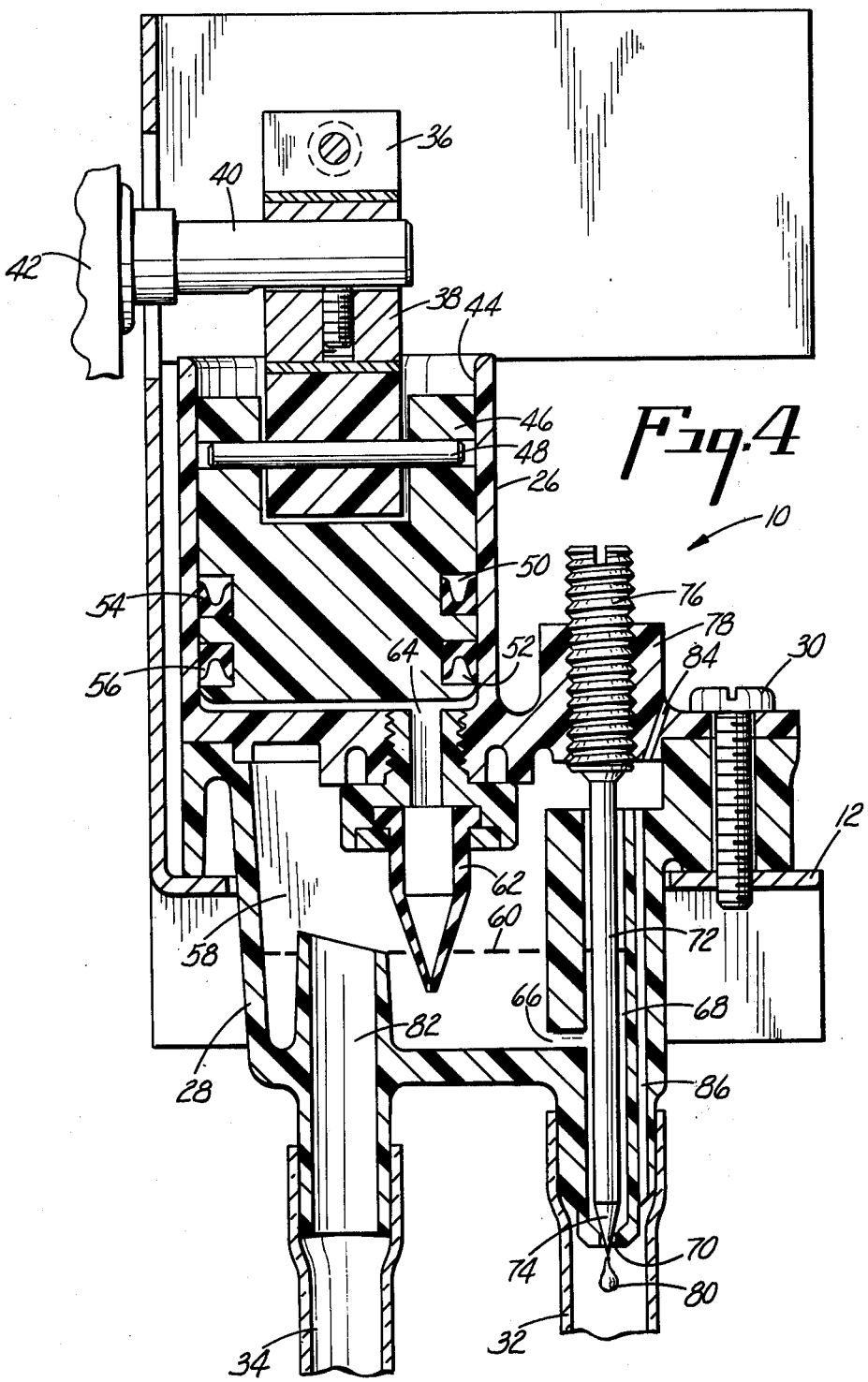
FIG. 4 is an enlarged section taken on the line 4—4 of FIG. 2.

Referring now to FIG. 4, the upper housing 26 is provided with a chamber 44 for receiving a piston 46. The piston 46 is pivotably mounted on a pin 48 provided in the connecting rod 36. As the motor 42 is driven, the drive shaft 40 rotates the eccentric member 38 thereby imparting movement to the connecting rod 36 in an orbital path and cyclically driving the piston 46 alternately through an upward stroke and a downward stroke within the chamber 44. The piston 46 is provided with a pair of spaced apart annular grooves 50 and 52 each retaining therein a seal 54 and 56 respectively. The seals 54 and 56 acting against the wall of the chamber 44 prevent leakage of air past the seals when the piston 46 is being driven in its upward and downward strokes.

Because the materials used in the construction of the pump 10 must be impervious to attack by chemically reactive fluids such as 26° B aqueous ammonia, the piston 46, connecting rod 36, upper housing 26 and lower housing 28 are preferably made of a plastic material which is resistant to attack by such fluids. The seals 54 and 56 are preferably fabricated of a chemically resistant rubber such as ethylene propylene rubber. Other types of seals than those shown in FIG. 4 such as O-rings may also be used. The seals must be fabricated of a material which is resistant to attack by reactive chemicals such as aqueous solutions.

The lower housing 28 provides a reservoir 58 for storing therein a quantity of ammonia 60. The ammonia 60 is delivered to the reservoir 58 from the chamber 44 through a one-way outlet valve 62 extending from an outlet port 64 at the bottom of the chamber 44 to the reservoir 58. The outlet valve 62 permits the flow of ammonia from the chamber 44 to the reservoir 58 but resists flow of ammonia from the reservoir back to the chamber. While the outlet valve 62 may be of any suitable design so long as it is made of material that is impervious to aqueous ammonia, or other reactive chemicals, for purposes of this disclosure the outlet valve is shown as being a rubber duck-bill type. A diaphram-type valve may also be used. The inlet valve 24 (FIG. 2) is also preferably of the duck-bill type and operates to permit flow of ammonia from the container 20 to the chamber 44, but prevents flow of ammonia from the chamber back to the container.

The reservoir 58 is provided with an outlet passage 66 to permit flow of the ammonia 60 from the reservoir to a well 68 provided at its lower end with a dispensing opening 70. Within the well 68 is a metering means such as a needle valve 72 provided with a pointed end 74 positioned in the dispensing opening 70, and provided at its upper end with a threaded body 76 in threaded engagement with a tapped hole provided in a boss 78 in the upper housing 26. By rotating the threaded body 76, the needle valve 72 is moved upwardly or downwardly to adjust the position of the pointed end 74 within the dispensing opening 70. In practice, good results have been attained by providing the needle valve 72 so as to be adjustable within a range to dispense from 3 to 13 ml. of ammonia per minute to the tube 32. The flow of ammonia from the reservoir 58 through the outlet passage 66 and the dispensing opening 70 to the tube 32 may thereby be accurately controlled.

The tube 32 is made of transparent material so that the machine operator may view the quantity of ammonia being dispensed in droplet form as shown at 80 and may quickly and easily alter the amount of ammonia flow by adjusting the needle valve 72. Here again, in order to be impervious to attack by the ammonia at least the stem portion of the needle valve 72 which is contacted by the ammonia 60 is preferably made of stainless steel or other suitable material resistant to attack by the ammonia.

An overflow port 82 is provided in the reservoir 59 for draining excess ammonia 60 from the reservoir through the drain tube 34 and back to the supply container 20. In this way, regardless of the amount of ammonia withdrawn from the supply container 20 to the chamber 44, and dispensed from the chamber 44 to the reservoir 58, the overflow port 82 permits the ammonia 60 within the reservoir 58 to be maintained at a uniform and constant level.

To prevent overheating or boiling of the ammonia, thereby causing malfunctioning of the pump and metering apparatus, the motor driven piston pump is designed to move a relatively large quantity of approximately 50 to 60 ml. of ammonia per minute. Thus, by maintaining the flow of ammonia at this level, the ammonia serves to cool the supply lines and the ammonia's tendency to boil is held in check.

In operation of the device, energization of the drive motor 42 drives the connecting rod 36 which, through eccentric member 38, imparts movement to the piston 46 in an upward stroke and a downward stroke. An upward stroke of the piston 46 creates a vacuum within the chamber 44 thereby drawing ammonia from the supply container 20 through the feed tube 22 and the inlet valve to the chamber 44. At this time the outlet valve 62 is in a closed condition thereby preventing the flow of ammonia from the chamber 44 to the reservoir 58. However, as the piston 46 is driven downwardly it pressurizes the chamber 44 thereby forcing the ammonia out of the chamber 44, through the outlet port 64 and opening the oulet valve 62 to transfer the ammonia from the chamber 44 to the reservoir 58. The ammonia 60 in the reservoir will seek a level in-line with the overflow port 82 and any excess ammonia in the reservoir will be drained back to the supply container 20 through the drain tube 34. The ammonia 60 in the reservoir 58 now travels through the outlet passage 66 to the well 68 and from there it is dispensed in droplets 80 through the dispensing opening 70 into the transparent tube 32 which leads to the developing unit 18 of the machine 16.

Figure 5:
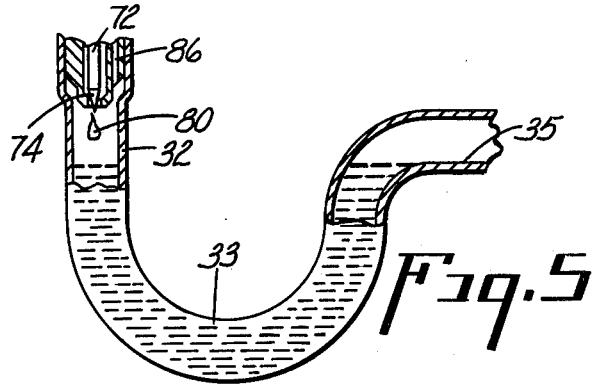
FIG. 5 is a front elevation, partially broken away, showing the feed of liquid from the pump to the utilization device.

The tube 32 is shown as having a formed portion or goose neck 33 (FIGS. 1 and 5) and is connected to the developing unit 18 at a level lower than the level at which the ammonia is dispensed into the tube by the dispensing opening 70. The goose neck 33 is adapted to maintain a quantity of ammonia therein. When the fluid in the goose neck 33 rises to a level in-line with the inside of a lower inside wall 35 of the straight portion of the tube 32 leading from the goose neck to the developing unit 18 as shown in FIG. 5, each time a drop 80 of ammonia is dispensed from the reservoir 58 to the tube 32 by the needle valve 72, an equal amount of ammonia is discharged from the other end of the tube 32 to the developing unit 18. Hence, depending upon the amount of ammonia required for the particular developing application, the needle valve, 72 may be adjusted to discharge a larger or smaller amount of ammonia from the reservoir 58, and a like amount of ammonia will be fed to the developing unit while maintaining the ammonia in the goose neck portion of the tube 32 at a uniform and constant level.

The supply of ammonia which is stored in the goose neck 33 of the tube 32 exists as both liquid and gas. The gas phase is allowed to reenter the reservoir 58 through a vent opening 86 provided adjacent and parallel with the stem of the needle valve, extending from the reservoir 58 to the tube 32, to thereby equilibrate the atmosphere in the tube 32 to that of the reservoir 58. Within the reservoir 58, the gaseous ammonia can either go back into solution or vent through a vent opening 84, adjacent the threaded body 76 of the needle valve 72, to equilibrate the reservoir 58 to the atmosphere. This arrangement resists ammonia vapor lock and prevents internal pressure build-up which would impede the ammonia flow, thereby permitting ammonia flow from the reservoir immediately upon initial machine start-up.

Although the ammonia fumes resulting from venting the device to the atmosphere are very minute, provisions are made to avoid discharge of fumes directly to the atmosphere. Thus, the device is vented to a cavity provided between the side plate 14 and a suitable machine side plate cover. A fan is associated with the cavity and is operable to exhaust the fumes to a suitable exhaust outlet or storage means.

From the foregoing, it will be appreciated that the present invention provides a pump and metering device for precisely and accurately controlling the rate of flow of volatile liquids and/or chemically reactive fluid. The device is self-priming and therefore is functional immediately upon initial machine start-up. The various components are made of materials which are impervious to attack by such fluids, thereby resulting in a unit which avoids sticking and inoperative valves and other components, is durable in use and reliable in operation.

What is claimed is:

1. A pump and metering apparatus for supplying a controlled amount of a volatile liquid from a liquid supply source to a utilization device, comprising:
   - a chamber for receiving volatile liquid from a liquid supply source;
   - a piston within the chamber movable in a first direction for drawing liquid from the liquid supply source to the chamber and movable in a second direction for dispensing liquid from the chamber;
   - means for moving the piston in the first and second directions;
   - a reservoir for storing the liquid dispensed from the chamber;
   - means operable between a closed position in response to movement of the piston in the first direction to prevent dispensement of liquid from the chamber, and an open position in response to movement of the piston in the second direction to dispense liquid from the chamber to the reservoir;
   - metering means for controlling the rate of flow of liquid from the reservoir to the utilization device;
   - a tube extending from the reservoir to the utilization device having one end thereof attached to the metering means for receiving drops of liquid dispensed therefrom, the other end of the tube attached to inlet means of the utilizaton device and a formed portion intermediate the said ends of the tube for storing a quantity of volatile liquid in which the volatile liquid exists as both liquid and gas, said one end of the tube positioned above the level of the other end of the tube to maintain the amount of liquid flow to the utilization device equal to the amount of liquid flow from the reservoir;
   - a first vent means to equilibrate the atmosphere in the tube by allowing the gas to re-enter the reservoir; and
   - a second vent means to equilibrate the reservoir to the atmosphere to prevent impediment to liquid flow.

2. An apparatus as set forth in claim 1 in which the tube is transparent to allow for viewing the amount of liquid being dispensed from the reservoir by the metering means.

3. An apparatus as set forth in claim 1 in which the volatile liquid comprises 26° B aqueous ammonia.

4. An apparatus as set forth in claim 1 in which the liquid comprises a chemically reactive fluid.

5. An apparatus as set forth in claim 1 further comprising:
   - valve means associated with the chamber operable between a closed position to prevent dispensement of liquid from the chamber in response to movement of the piston in the first direction and an open position to dispense liquid from the chamber to the reservoir in response to movement of the piston in the second direction.

6. An apparatus as set forth in claim 1 in which the means for moving the piston comprises:
   - a connecting rod pivotally mounted on the piston;
   - an eccentric member rotatably supported by the connecting rod; and
   - a drive motor for cyclically driving the connecting rod to impart movement to the piston in response to rotation of the eccentric member.

7. An apparatus as set forth in claim 1 further comprising an overflow port associated with the reservoir for draining excess liquid from the reservoir back to the supply source, whereby the quantity of liquid in the reservoir is maintained at a uniform and constant level.

8. A method of pumping and metering a controlled amount of volatile liquid from a liquid supply source to a utilization device, comprising the steps of:

pumping liquid from the supply source to an inlet supply line extending from the supply source for delivering liquid to a reservoir;

dispensing liquid from the reservoir to a feed supply line extending from the reservoir to the utilization device;

metering the rate of flow of liquid from the reservoir to the feed supply line;

storing a supply of liquid in the feed supply line between the reservoir and the utilization device;

attaching one end of the feed supply line to the reservoir at a position above the level of the other end of the feed supply line attached to the utilization device to maintain the rate of liquid flow to the utilizaton device equal to the rate of liquid flow from the reservoir;

utilizing the liquid to cool the supply lines by pumping the liquid at a flow level of about 50 to 60 ml. of liquid per minute;

venting the feed supply line to the reservoir; and venting the reservoir to the atmosphere to prevent impediment to liquid flow.

* * * * *

UNITED STATES PATENT OFFICE

CERTIFICATE OF CORRECTION

Patent No. 4,023,592 Dated May 17, 1977

Inventor(s) Robert C. Patzke etal.

It is certified that error appears in the above-identified patent and that said Letters Patent are hereby corrected as shown below:

Column 1, line 28, "becom" should read -- become --.

Column 2, line 62, "elevational" should read -- elevation --.

Column 3, line 62, after "aqueous" insert -- ammonia --.

Column 4, line 42, "59" should read -- 58 --.

Signed and Sealed this

Second Day of May 1978

[SEAL]

Attest:

RUTH C. MASON
Attesting Officer

LUTRELLE F. PARKER
Acting Commissioner of Patents and Trademarks